US005496651A

United States Patent [19]

Nishimoto et al.

[11] Patent Number: 5,496,651

[45] Date of Patent: Mar. 5, 1996

[54] MACHINE PART RESISTANT TO ROLLING FRICTION

[75] Inventors: Hidetoshi Nishimoto; Yasuaki Sugizaki, both of Kobe; Kenji Umei, Kakogawa; Hiroshi Satoh, Kobe; Yoshinori Terada, Osaka; Tatsuya Yasunaga, Kobe; Takenori Nakayama, Kobe; Yasunori Wada, Kobe; Keiji Ueda, Kobe, all of Japan

[73] Assignee: Kabushiki Kaisha Kobe Seiko Sho, Kobe, Japan

[21] Appl. No.: 387,622

[22] Filed: Feb. 13, 1995

Related U.S. Application Data

[63] Continuation of Ser. No. 12,761, Feb. 3, 1993, abandoned.

[51] Int. Cl.[6] ..... B32B 15/00; C25D 3/56

[52] U.S. Cl. ..... 428/612; 205/172; 205/185; 205/258; 428/469; 428/472.2; 428/652; 428/660; 428/935

[58] Field of Search ..... 428/612, 652, 428/660, 935, 469, 472.2; 205/172, 185, 258

[56] References Cited

U.S. PATENT DOCUMENTS 3,981,781 9/1976 Mori et al. ..... 205/109

4,388,379 6/1983 Klingenmaier ..... 428/613

FOREIGN PATENT DOCUMENTS 4-26792 1/1992 Japan .

OTHER PUBLICATIONS

Abner Brenner, Electrodeposition of Alloys, Principles and Practice, Academic Press, New York, 1963, vol. I, pp. XIX.

H. Silman et al, Protective and Decorative Coatings For Metals, Finishing Publications Ltd., Teddington, Middlesex, England, 1978, pp. 345–346.

F. A. Lowenheim, Electroplating, McGraw–Hill Book Co., New York, 1978, pp. 89–91.

*Primary Examiner*—John Niebling
*Assistant Examiner*—William T. Leader
*Attorney, Agent, or Firm*—Oblon, Spivak, McClelland, Maier & Neustadt

[57] ABSTRACT

A machine part comprises: a base part formed of a titanium alloy or an aluminum alloy and having a roughened surface of Ra 0.5 μm or above and $PPI_{50}$ or above; and a Ni—P electrodeposit layer formed over the surface of the base part by an electroplating process using a Ni—P plating bath containing a stress relaxing agent, and having a stress of 20 kgf/mm$^2$ or below. The machine part has a small specific gravity, excellent seizure resistance, wear resistance and fatigue strength.

12 Claims, 4 Drawing Sheets

MACHINE PART RESISTANT TO ROLLING FRICTION

This application is a Continuation of application Ser. No. 08/012,761, filed on Feb. 3, 1993, now abandoned.

BACKGROUND OF THE INVENTION

1. Field of the Invention

The present invention relates to a machine part, such as a gear for a vehicle, a coil spring, a valve for an internal-combustion engine or a part of a machine, having excellent rolling wear resistance.

2. Description of the Prior Art

Studies of stress relaxing agents, such as sodium benzenesulfonate, paratoluene sulfonamide and saccharin, for relaxing electrodeposit layers have been made and the results of studies have been applied to practical uses. Techniques of Ni—P electroplating machine parts to improve the wear resistance of the machine parts are disclosed in Japanese Patent Laid-open (Kokai) Nos. Sho 61-179899, Sho 63-295855, Sho 63-311624, Hei 1-158211 and Hei 3-18682. Nevertheless, only few studies of the stress relaxation of electrodeposit layers have been made, because Ni—P electroplating has been applied to forming relatively thin electrodeposit layers having a thickness on the order of 10 μm.

The inventors of the present invention have made studies of Ni—P electroplating to improve the rolling wear resistance of machine parts of titanium alloys and aluminum alloys for use particularly as machine parts of automobiles and bicycles. The results of the studies are disclosed in Japanese. Patent Laid-open (Kokai) No. Hei 4-26792. The inventors of the present invention have found through the studies that the Ni—P electrodeposit layers must withstand a very high bearing stress of several hundred kilograms force per square millimeter that will be induced in the machine part due to point contact or line contact to improve the rolling wear resistance of the machine part. The Ni—P electrodeposit layer must be formed in a thickness of several hundred micrometers, which is far greater than the thickness of the Ni—P electrodeposit layer which has been used, to withstand such a high bearing stress. However, if such a very thick Ni—P electrodeposit layer is formed by using a plating bath of a conventional composition under conventional electroplating conditions, namely, current density, the temperature of the plating bath, the pH of the plating bath and so forth, the very thick Ni—P electrodeposit layer will be cracked or will fall off the machine part, and the stress in the electrodeposit layer will break the very thick Ni—P electrodeposit layer when machining the Ni—P electrodeposit layer or when using the machine part coated with the Ni—P electrodeposit layer.

The Ni—P electrodeposit layer coating a machine parts that will be exposed to rolling wear must have a thickness of several hundred micrometers so that the Ni—P electrodeposit layer is able to withstand a high bearing stress of several hundred kilograms force per square millimeter. However, a stress is induced in the Ni—P electrodeposit layer when the Ni—P electrodeposit layer is formed by the conventional Ni—P electroplating process, and the stress induced in the Ni—P electrodeposit layer will cause the Ni—P electrodeposit layer to be cracked, to fall off the machine part or to be broken when the machine part coated with the Ni—P electrodeposit layer is subjected to finishing machining or to a high load.

SUMMARY OF THE INVENTION

Accordingly, it is a first object of the present invention to provide a structural composite material formed by Ni—P electroplating using a plating bath containing a stress relaxing agent for relaxing stress induced in a Ni—P electrodeposit layer, and having high resistance to rolling wear.

The present invention is disclosed in Japanese Patent Laid-open (Kokai) Nos. Hei 4-136183 (May 11, 1992), Hei 4-154981 (May 27, 1992), Hei 4-237809 (Aug. 6, 1992) and Hei 4-259395 (Sep. 14, 1992).

The present invention has been made on the basis of knowledge that stress induced in an electrodeposit layer can be relaxed by forming the electrodeposit layer in a plating bath containing a stress relaxing agent.

A machine part in a first aspect of the present invention comprises: a base part formed of a titanium alloy or an aluminum alloy and having a toughened surface of Ra 0.5 μm or above and $PPI_{50}$ 130 or above; and a Ni—P electrodeposit layer formed over the surface of the base part by an electroplating process using a Ni—P plating bath containing a stress relaxing agent, and having a stress of 20 $kgf/mm^2$ or below.

In a second aspect of the present invention, the Ni—P electrodeposit layer coating the base part has a Vickers hardness of Hv 400 or above, a thickness in the range of 1.0 to 200 μm and a P content in the range of 0.5 to 7.0% by weight.

In a third aspect of the present invention, the base part of the machine part having the Ni—P electrodeposit layer coating the base part is formed of an aluminum alloy, and an aluminum oxide layer is formed over the surface of the base part.

In a fourth aspect of the present invention, the base part is formed of an aluminum alloy, and a zincate layer is formed between the surface of the base part and the Ni—P electrodeposit layer.

In a fifth aspect of the present invention, the Ni—P layer has a Vickers hardness in the range of Hv 550 to Hv 700.

In a sixth aspect of the present invention, the Ni—P layer has a thickness in the range of 10 to 50 μm.

In a seventh aspect of the present invention, the Ni—P layer has a P content in the range of 0.5 to 3.9% by weight.

In an eighth aspect of the present invention, the stress in the Ni—P layer is ±5.0 $kgf/mm^2$ or below.

In a ninth aspect of the present invention, the stress relaxing agent is saccharin, sodium saccharin, paratoluene sulfonamide, sodium benzenesulfonate or a mixture of two or more chemicals among these chemicals, and the stress relaxing agent concentration of the Ni—P plating bath is in the range of 0.01 to 2.0 g/l.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

The features and bases of the present invention will be described prior to the description of the preferred embodiments of the present invention.

Ni—P plated machine parts were produced by coating titanium alloy base parts with Ni—P electrodeposit layers formed by electroplating processes using plating baths containing 100 to 200 g/l $NiSO_4.6H_2O$, 40 to 200 g/l $NiCl_2.6H_2O$, 0.5 to 10 g/l $H_3BO_3$, 2 to 20 g/l $H_3PO_3$, 10 to 150 g/l $H_3PO_4$, and 0.01 to 5.0 g/l stress relaxing agent containing one or a plurality of chemicals among saccharin, sodium saccharin, paratoluene sulfonamide and sodium benzenesulfonate, respectively, and a Ni anode. Electroplating conditions were: 40° to 70° C. in bath temperature, 5 to 50 A/dm$^2$ in current density and 0.5 to 3.0 in pH.

Stresses in the Ni—P electrodeposit layers were measured and the machine parts were subjected to rolling wear tests to evaluate the rolling wear properties of the machine parts.

It was found through the measurement that addition of one or a plurality of chemicals among saccharin, sodium saccharin, paratoluene sulfonamide and sodium benzenesulfonate to the plating bath in a concentration in the range of 0.01 to 2.0 g/l reduces stress in the Ni—P electrodeposit layers effectively.

In Japanese Patent Laid-open (Kokai) No. Hei 4-26792, the inventors of the present invention disclosed facts that the hardness of electrodeposit layers must be Hv 500 or above to provide the machine parts with sufficiently high rolling wear resistance, the surface roughness of the base parts prepared in an Ra of 0.5 μm or above and a $PPI_{50}$ of 130 or above by etching or shot blasting provide a strong anchoring effect for firmly anchoring the electrodeposit layer to the surfaces of the base parts of a titanium alloy or an aluminum alloy, a preferable P content of the surfaces of the electrodeposit layers is in the range of about 2 to about 7%, and the gradient distribution of P content in the electrodeposit layers in the direction of thickness of the same improves the rolling wear resistance effectively.

Requisite conditions of the present invention will be described hereinafter with reference to the measured stress induced in electrodeposit layers and the results of rolling wear resistance tests.

Figure 1:
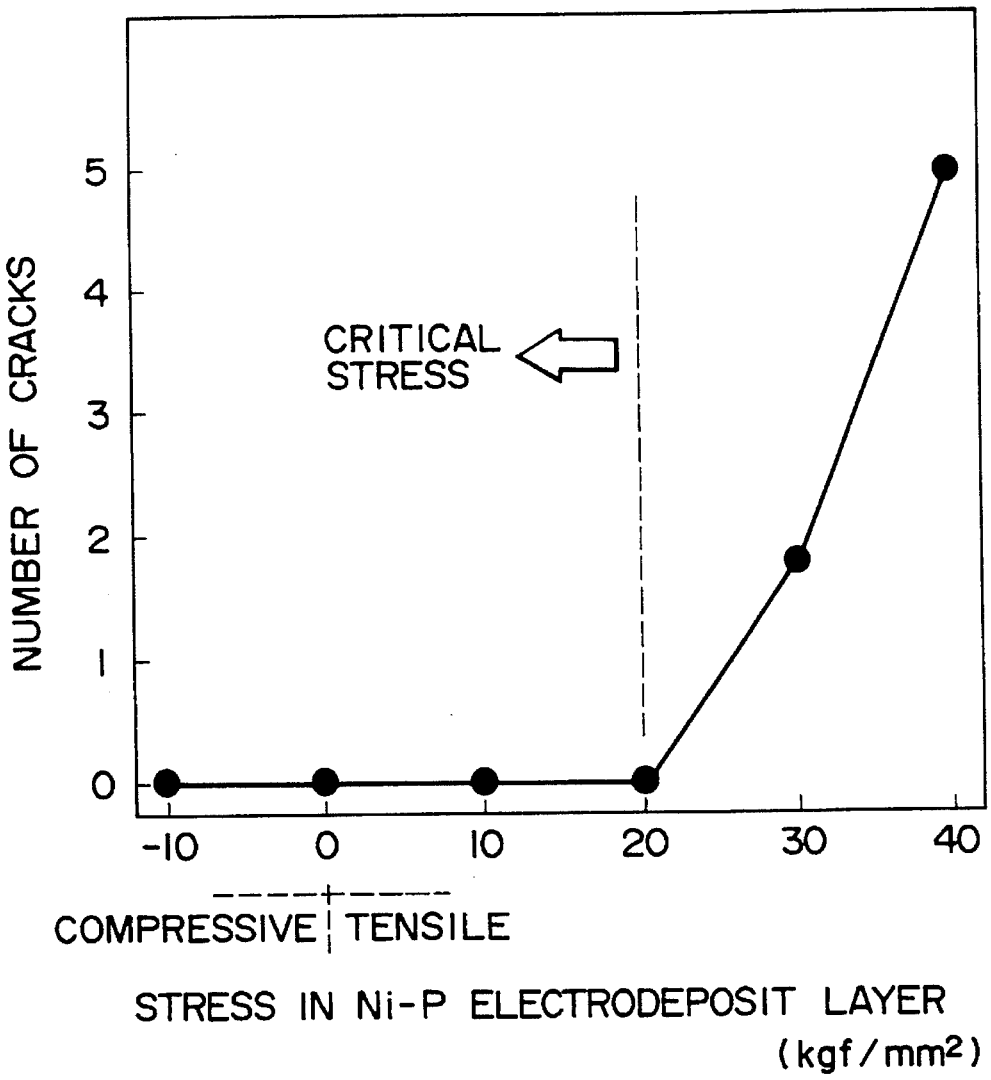
FIG. 1 is a graph showing the variation of the number of cracks formed in electrodeposit layers with stress induced in the electrodeposit layer.

As shown in FIG. 1, the electrodeposit layer was cracked when tensile stress induced therein exceeded 20 kgf/mm$^2$. Therefore, the tensile stress in the electrodeposit layer must be suppressed to a value below 20 kgf/mm$^2$. The sample electrodeposit layers were 20 μm in thickness, and the tensile stress was measured by a spiral contract meter.

Figure 2:
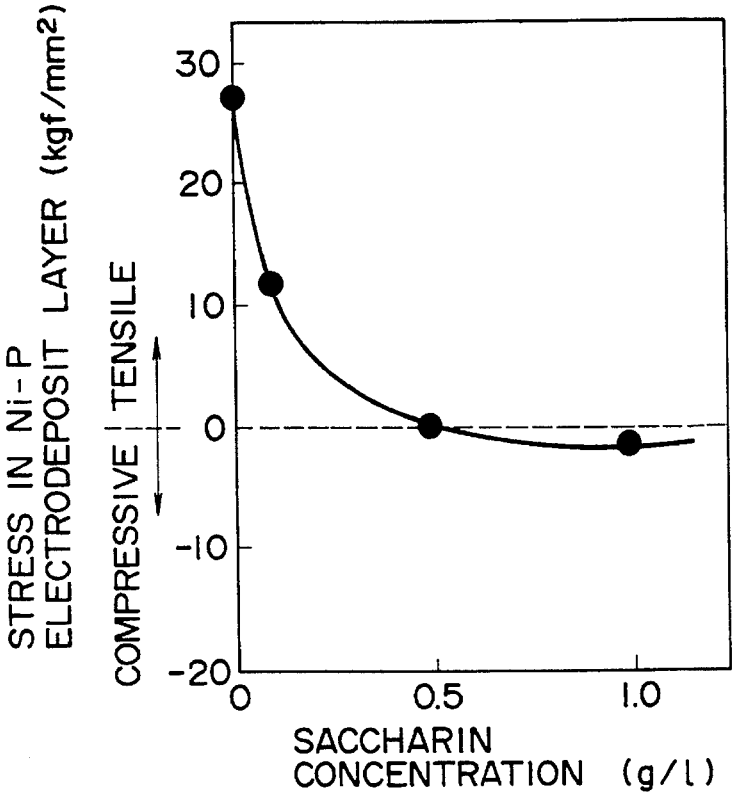
FIG. 2 is a graph of assistance in explaining the effect of a stress relaxing agent on stress induced in electrodeposit layers formed by electroplating.

FIG. 2 shows the stress relaxing effect of saccharin on stress induced in electrodeposit layers of 20 μm in thickness formed under electroplating conditions: 60° C. in the temperature of the plating bath, 15 A/dm$^2$ in current density and 1.15 in the pH of the plating bath. As is obvious from FIG. 2, the tensile stress in the electrodeposit layer was very high when the saccharin concentration was zero, the tensile stress decreased with the increase of the saccharin concentration, and the tensile stress changed into compressive stress when the saccharin concentration exceeded a certain value. The concentration of the stress relaxing agent must be 0.01 g/l or above to suppress the tensile stress below 20 kgf/mm$^2$ and the highest necessary concentration of the stress relaxing agent is 2.0 g/l.

Figure 3:
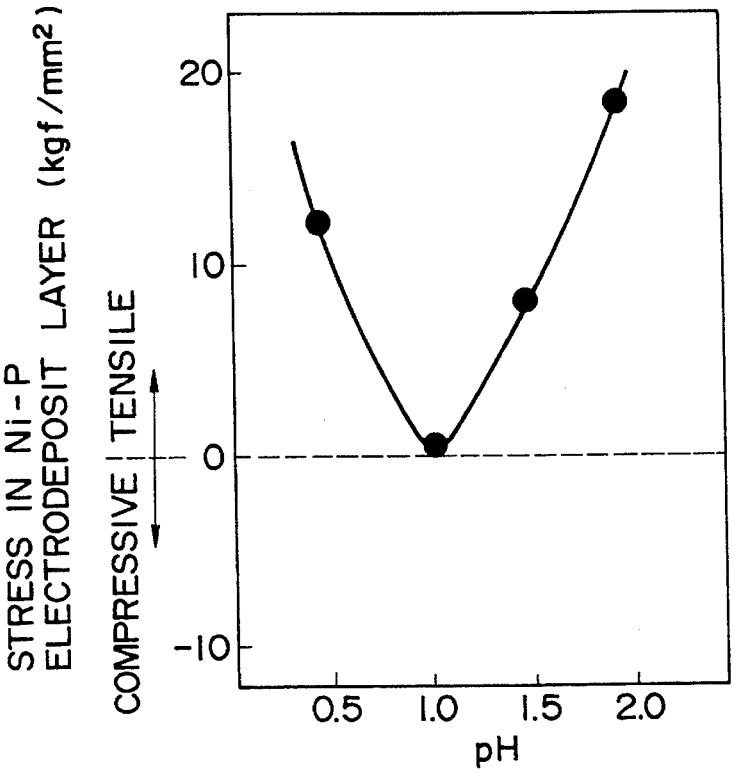
FIG. 3 is a graph of assistance in explaining the effect of the pH of the plating bath on stress induced in electrodeposit layers formed by electroplating.

FIG. 3 shows the effect of pH of the plating bath on the stress induced in the electrodeposit layer of 20 μm in thickness formed under electroplating conditions: 0.5 g/l in the saccharin concentration of the plating bath, 60° C. in the temperature of the plating bath and 15 A/dm$^2$ in current density. The tensile stress was 20 kgf/mm$^2$ or below when the pH of the plating bath was in the range of 0.5 to 2.0. Under different plating conditions, the pH of the plating bath could be 3.0. Therefore, an appropriate pH of the plating bath is in the range of 0.5 to 3.0.

Figure 4:
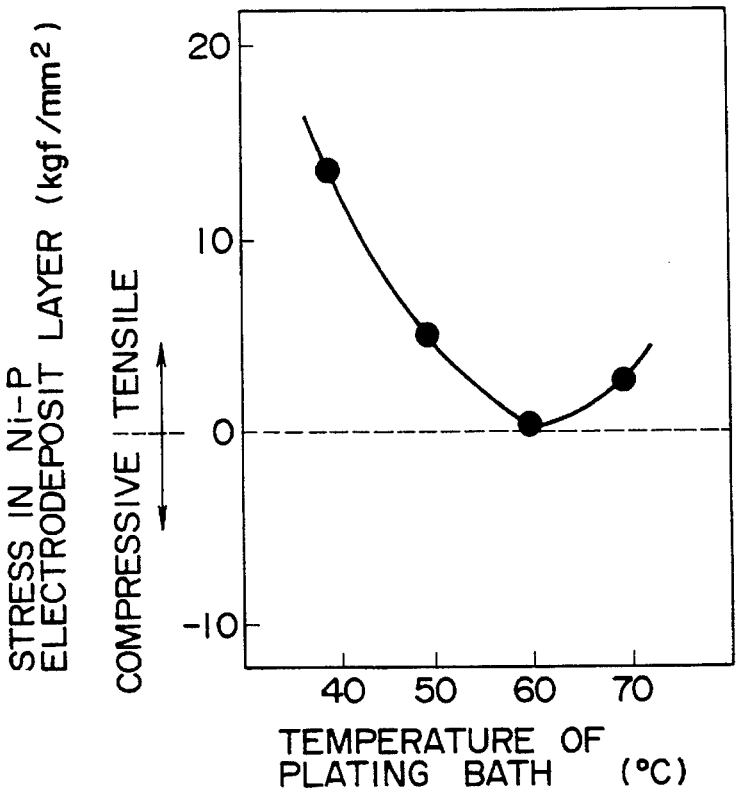
FIG. 4 is a graph of assistance in explaining the effect of the temperature of a plating bath on stress induced in electrodeposit layers formed by electroplating.

FIG. 4 shows the effect of the temperature of the plating bath on the stress induced in the electrodeposit layer of 20 μm in thickness formed under plating conditions: 0.5 g/l in the saccharin concentration of the plating bath, 1.14 in the pH of the plating bath and 15 A/dm$^2$ in current density. As is obvious from FIG. 4, the temperature of the plating bath must be 40° C. or above to suppress the tensile stress induced in the electrodeposit layer to a 20 kgf/mm$^2$ or below. If the temperature of the plating bath exceeds 70° C., no electrodeposit is formed. Therefore, an appropriate temperature of the plating bath is in the range of 40° to 70° C.

Figure 5:
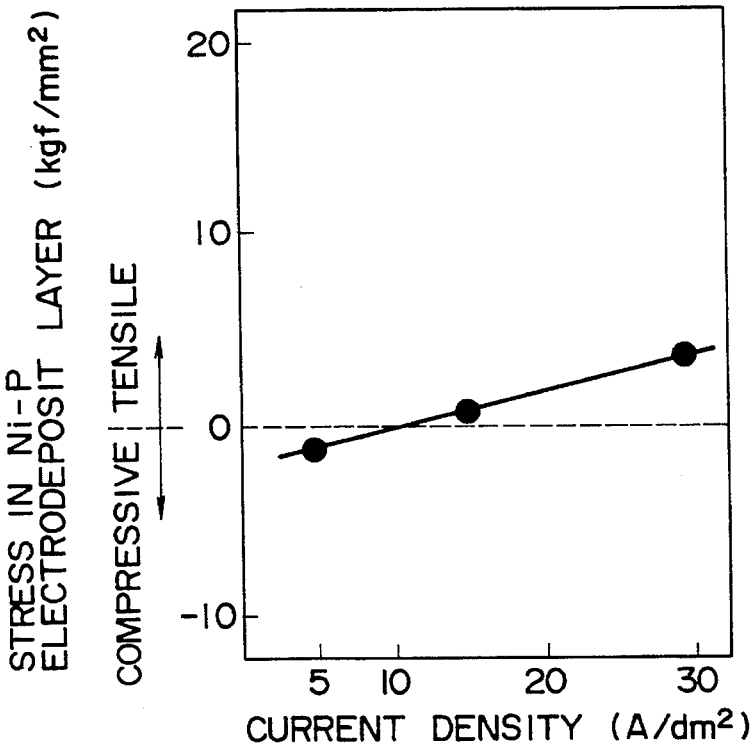
FIG. 5 is a graph of assistance in explaining the effect of current density on stress induced in electrodeposit layers formed by electroplating.

FIG. 5 shows the effect of current density on the stress induced in an electrodeposit layer of 20 μm in thickness formed under plating conditions: 0.5 g/l in saccharin concentration, 1.14 in the pH of the plating bath, and 60° C. in the temperature of the plating bath. As is obvious from FIG. 5, the stress induced in the Ni—P electrodeposit layer increased in proportion to the current density. A current density suitable for suppressing the tensile stress to 20 kgf/mm$^2$ or below is in the ordinary current density range of 5 to 30 A/dm$^2$. However, in view of productivity, the current density may be in the range of 5 to 50 A/dm$^2$.

The results of rolling wear resistance tests proved that the Ni—P electrodeposit layers in accordance with the present invention have excellent rolling wear resistance.

Examples of machine parts in accordance with the present invention will be explained hereinafter.

Gears are used widely in bicycles, automobiles, aircraft and the like for transmitting power. It is essential that gears have high power transmission ability, excellent wear resistance, pitting resistance, flaking resistance and fatigue cracking resistance. Generally, gears are formed of carbon steels and the tooth surfaces of gears are hardened by induction hardening or flame hardening. Some lightweight gears are formed of aluminum alloys. However aluminum alloy gears have poor wear resistance. Although the surfaces of aluminum alloy gears, in general, are anodized to improve the wear resistance, the wear resistance of such anodized aluminum alloy gears is not high enough.

Al—Cu alloys 2014 and 2017, and Al—Mg alloy 5083 (A.A. Standards) are used for forming gears having sufficiently high strength.

The teeth of a gear is brought into wear repeatedly with the teeth of a mating gear or a driving chain or the like at a bearing pressure in the range of several tens to several hundred kilograms force per square millimeter and the teeth of the gear is caused to fatigue by the repeated stress. It was found through experiments that the wear of the teeth of gears is mainly due to fatigue and the synergetic effects of wear and fatigue causes the surfaces of the teeth of gears to flake. Such a mode of wear occurs in titanium alloy coil springs for biasing the intake and exhaust valves of gasoline engines and diesel engines. Some gears incorporated into a chain transmission are shaved by the chain in changing the speed.

Generally, the fatigue characteristics of a material is closely related with the toughness of the material. The enhancement of the toughness enhances the fatigue strength. However, if the hardness is excessively high, the toughness is reduced and the fatigue resistance of the material deteriorates. Generally, the wear resistance of a material can be improved by increasing the hardness of the material. Accordingly, the wear resistance of gears of a titanium alloy or an aluminum alloy cannot be enhanced simply by coating the surface of the gears with a Ni—P electrodeposit layer having a high hardness; the toughness of the Ni—P electrodeposit layer must be taken into consideration in determining the hardness of the same. It was found through experiments that a Ni—P electrodeposit layer having a thickness in the range of 10 to 200 μm, a hardness of Hv 400 or above, and a P content in the range of 0.5 to 7.0% by weight has a sufficiently high wear resistance and a sufficiently high fatigue strength.

A gear coated with a Ni—P electrodeposit layer meeting such conditions have a high wear resistance and a high fatigue strength. The wear resistance of a Ni—P electrodeposit layer having a hardness lower than Hv 400 is insufficient. The strength of a Ni—P electrodeposit layer of a thickness less than 10 μm is excessively low and the Ni—P electrodeposit layer is unable to withstand a high bearing stress that will be induced therein when the gears are engaged. A Ni—P electrodeposit layer of a thickness greater than 200 μm is expensive and economically unprofitable and makes the weight reduction of the gear difficult. The hardness of a Ni—P electrodeposit layer of a P content below 0.5% by weight is not high enough and the wear resistance of the same is not satisfactory. The toughness of a Ni—P electrodeposit layer of a P content greater than 7.0% by weight is insufficient and the fatigue strength of the same is not high enough.

As is apparent from the foregoing description, a gear in accordance with the present invention has a small specific gravity and excellent in seizure resistance, wear resistance, surface fatigue resistance and durability.

The Ni—P electrodeposit layer may be formed over the entire surface of a gear, the tooth surfaces of the gear or only portions of the surface to be brought into contact with a driving chain or the like. However, in view of reducing the weight of the gear, it is desirable to form the Ni—P electrodeposit layer over only the least necessary portions of the surface of the gear.

An anodized layer or a zincate layer formed in the surface of a gear of an aluminum alloy so as to underlie the Ni—P electrodeposit layer further enhances the adhesion of the Ni—P electrodeposit layer to the surface of the gear, because the anodized layer have many pinholes having an anchoring effect to anchor the Ni—P electrodeposit layer firmly thereto, so that the Ni—P electrodeposit layer is difficult to separate from the surface of the gear.

It is desirable to form an anodized layer or a zincate layer in the surface of the base part of an aluminum alloy before plating the base part with a Ni—P electrodeposit layer to prevent the following problems.

The surface of an aluminum alloy part is liable to be oxidized and an oxide film is liable to be formed over the surface of the aluminum alloy part, the surface of the aluminum alloy part is electrochemically active and hence subject to erosion by an electrolytic solution, pinholes are liable to be formed in a electrodeposit layer, and the adhesion between the surface of the aluminum alloy part and the electrodeposit layer is reduced by the difference in thermal expansion between the aluminum alloy part and the electrodeposit layer to deteriorate the quality of the electrodeposit layer. Thus, it is difficult to form an electrodeposit layer of a satisfactory quality directly over the surface of the aluminum alloy part and hence it is desirable to form an anodized layer or a zincate layer under the electrodeposit layer.

In anodizing the surface of an aluminum alloy part to form an anodized layer, a suitable quantity of electricity to be supplied is in the range of 10 to 500 C/dm$^2$. An anodized layer effective on the enhancement of the adhesion of the Ni—P electrodeposit layer to the base part cannot be formed if the quantity of electricity is less than 10 C/dm$^2$, and an anodizing process requiring a quantity of electricity exceeding 500 C/dm$^2$ is economically in feasible. In the anodizing process, the aluminum alloy base part is degreased, washed with water, subjected to a surface activating treatment and immersed in a phosphoric acid solution or a sulfuric acid solution.

A preferable weight per unit area of an anodized layer is in the range of 0.1 to 5.0 g/dm$^2$. An anodized layer effective on the enhancement of the adhesion of the Ni—P electrodeposit layer to the base part cannot be formed if the weight per unit area is less than 0.1 g/dm$^2$, and an anodized layer formed in a weight per unit area exceeding 5.0 g/dm$^2$ is economically disadvantageous. A double zincate forming process is preferable.

Examples of the present invention will be described hereinafter.

First Embodiment

Base parts of a titanium alloy, such as Ti-6Al—4V, were subjected to a degreasing process, a first washing process, an etching process, a second washing process and a surface activating process in that order for pretreatment. The base parts thus pretreated were subjected to electroplating under the following electroplating conditions to form a Ni—P layer over the surface of each base part.

Plating Baths $NiSO_4.6H_2O$: 130 to 150 g/l $NiCl_2.6H_2O$: 120 to 170 g/l $H_3BO_3$: 1 to 5 g/l $H_3PO_3$: 4 to 8 g/l $H_3PO_4$: 30 to 60 g/l Stress relaxing agent: 0.1 to 2.1 g/l One or a plurality of chemicals among saccharin, sodium benzenesulfonate and paratoluene sulfonamide were used as stress relaxing agents, current density, the pH and temperature of the plating baths were varied. A Ni-anode was used.

Stress induced in the Ni—P electrodeposit layers of 20 μm in thickness was measured with a spiral contract meter, and the rolling wear resistance of test specimens coated with Ni—P electrodeposit layers of a thickness in the range of 0.3 to 0.5 mm was evaluated. The P content and hardness of the Ni—P electrodeposit layers were measured. The rolling wear resistance was measured with a rolling wear tester shown in FIG. 6.

Figure 6:
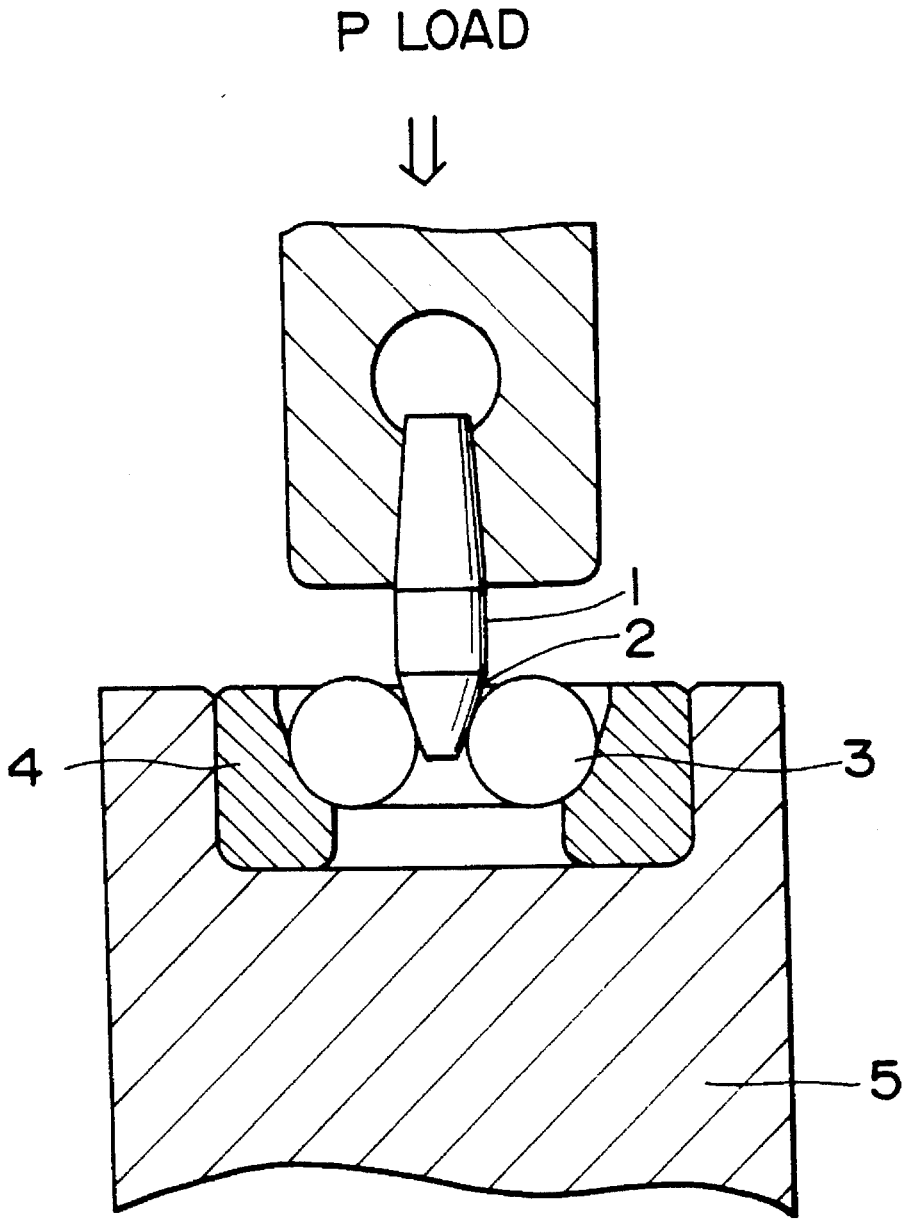
FIG. 6 is a schematic sectional view of a rolling wear tester.

As shown in FIG. 6, when testing the wear resistance of a test specimen 1, the test specimen 1 was held with the chuck of the rolling wear resistance tester, and tapered evaluation surface 2 of specimen in contact with a plurality of balls 3 retained on a bearing race 4 attached to a rotary shaft 5.

A load P of 100 kgf was applied to the test specimen 1 and the rotary shaft 5 was rotated at 100 rpm. The rolling wear resistance of the test specimen 1 was represented by the cycles of rotation of the rotary shaft 5 in a time from the start of the rotary shaft 5 to a moment when the vibrational acceleration exceeded 0.3 G. Test results and plating conditions are summarised in Table 1.

As is obvious from Table 1, the stresses induced respectively in the Ni—P electrodeposit layers of the test specimens in accordance with the present invention are as low as 10 kgf/mm$^2$ or below, whereas the stresses induced respectively in the Ni—P electrodeposit layers, which were formed by using plating baths not containing any stress relaxing agent, of the comparative examples are as high as 20 kgf/mm$^2$ or above. The rolling wear resistance of the Ni—P electrodeposit layers in accordance with the present invention is far higher than that of the Ni—P electrodeposit layers of the comparative examples. The P content and hardness of the Ni—P electrodeposit layers of the present invention are equal to desired values, respectively.

Second Embodiment

Cylinders of different aluminum alloys were subjected to a degreasing process, a first washing process, a chemical etching process, a second washing process and a surface activating process using hydrofluoric acid in that order for pretreatment. Some of the pretreated cylinders were subjected to an anodizing process and the rest were subjected to a zincate layer forming process. Then, the cylinders were coated with Ni—P electrodeposit layers by different electroplating processes, respectively, to obtain test specimens Nos. 1 to 18.

Plating Baths $NiSO_4.6H_2O$: 200 g/l $NiCl_2.6H_2O$: 50 g/l $H_3PO_3$: 4 to 40 g/l $H_3PO_4$: 50 g/l $H_3BO_3$: 0.5 to 3 g/l Saccharin: 0.1 to 1.0 g/l Temperature: 60° C.±5° C.

pH: 1±0.5

Current density: 5 to 30 A/dm$^2$

The plating baths were stirred by air during plating and the plating conditions were controlled so that the stress induced in the Ni—P electrodeposit layers is within ±5 kgf/m$^2$.

The hardness of the Ni—P electrodeposit layers of the test specimens thus obtained were measured, the test specimens were subjected to an wear resistance test, and the surfaces of the test specimens were observed visually after the wear resistance test to evaluate the wear resistance of the Ni—P electrodeposit layers.

The quality of the aluminum alloys, the process conditions of the anodizing process and the zincate layer forming process, the P content, hardness and thickness of the Ni—P electrodeposit layers, and the result of evaluation of the wear resistance of the test specimens are summarised in Table 2, in which test specimens Nos. 1 to 13 are those meeting the requisite conditions of the present invention and test specimens Nos. 14 to 18 are comparative examples. Although the respective hardnesses of all the test specimens Nos. 1 to 18 are higher than Hv 400, the test specimens Nos. 14 and 15 are inferior in rolling wear resistance, which is inferred to be due to the P content of their Ni—P electrodeposit layers of 8% by weight or above, and the test specimens Nos. 16 to 18 are quite inferior in rolling wear resistance because they are not provided with any Ni—P electrodeposit layer.

The test specimens Nos. 1 to 13 meeting the requisite conditions of the present invention are excellent in rolling wear resistance. The test specimens Nos. 1 to 13, 14 and 15 are excellent in the adhesion of the Ni—P electrodeposit layers to the aluminum alloy cylinders.

Third Embodiment

Cylinders of different titanium alloys formed through a hot forming process, a drawing process and an aging process were subjected to a degreasing process, a first washing process, a chemical etching process using a fluoride, a second washing and a surface activating process in that order for pretreatment. The pretreated cylinders were coated respectively with Ni—P electrodeposit layers by different electroplating processes to obtain test specimens Nos. 1 to 18 in Table 3. The same plating baths as those used for electroplating the test specimens in the second embodiment were used and the electroplating conditions were regulated so that the stress induced in the Ni—P electrodeposit layers is in the range of ±5 kgf/mm$^2$. During the electroplating process, the plating bath was stirred by air. Test specimens thus obtained were subjected to heat treatment of conditions as shown in Table 3.

The hardness of the Ni—P electrodeposit layers was measured and the test specimens were subjected to rolling wear resistance tests. In the rolling wear resistance tests, the test specimens were held in contact with each other so that the bearing stress, i.e., Hertz's contact pressure, was 200 kgf/mm$^2$ and the test specimens were rotated at a surface velocity in the range of 60 to 100 m/min and a slip ratio in the range of −70 to +40. The test specimens were lubricated by a mobile oil during rotation. The condition of the surfaces of the test specimens were observed visually after rotating the same by $5\times10^7$ cycles to evaluate the rolling wear resistance.

Test results are summarised in Table 3, in which the test specimens Nos. 1 to 13 are those meeting the requisite conditions of the present invention and the test specimens Nos. 14 to 18 are comparative examples. Although the respective hardnesses of the Ni—P electrodeposit layers of all the test specimens Nos. 1 to 18 are higher than Hv 400, the test specimens Nos. 14 and 15 are quite inferior in rolling wear resistance, which is inferred to be due to the high P content of 10% by weight of their Ni—P electrodeposit layers, and the test specimens Nos. 16 to 18 are quite inferior in rolling wear resistance because they are not provided with any Ni—P electrodeposit layer.

The test specimens Nos. 1 to 13 meeting the requisite conditions of the present invention are excellent in rolling wear resistance, and the adhesion of the Ni—P electrodeposit layers to the corresponding titanium alloy cylinders of the test specimens Nos. 1 to 15 was satisfactory.

Fourth Embodiment

Coil springs were formed by coiling wires of 3.0 mm in diameter of different titanium alloys through a hot forming process, a wire drawing process and an aging process. The coil springs were subjected to a degreasing process, a first washing process, a chemical etching process using a fluoride, a second washing process and a surface activating process in that order for pretreatment. The pretreated coil springs were coated with Ni—P electrodeposit layers by electroplating using the same plating baths as those used for forming the Ni—P electrodeposit layers of the test specimens in the second and third embodiments. The plating conditions were regulated so that a relatively low stress is induced in the Ni—P electrodeposit layers. The coil springs coated respectively with the Ni—P electrodeposit layers were subjected to heat treatment to obtain test specimens Nos. 1 to 18.

The quality of the titanium alloys, the P-content, thickness and hardness of the Ni—P electrodeposit layers are summarised in Table 4.

The adhesion of the Ni—P electrodeposit layers to the corresponding coil springs of titanium alloys and the wear resistance of the Ni—P electrodeposit layers were tested. In the wear resistance tests, the test specimens were held in contact with each other at a contact pressure in the range of 60±40 kgf/mm$^2$ and the wires forming the coil springs were abraded $10^7$ times with each other. The surface conditions of the wear test specimens were observed visually to evaluate the wear resistance.

Test results are summarised in Table 4, in which the test specimens Nos. 1 to 13 are those meeting the requisite conditions of the present invention and the test specimens Nos. 14 to 18 are comparative examples. The test specimens Nos. 14 and 15 are quite inferior in wear resistance, which is inferred to be due to the high P content of 10% by weight of their Ni—P electrodeposit layers, and the test specimens Nos. 16 to 18 are quite inferior in wear resistance because the coil springs of the test specimens Nos. 16 to 18 are not coated with any Ni—P electrodeposit layer. The test specimens Nos. 1 to 13 meeting the requisite conditions of the present invention are excellent in wear resistance, and the wear resistance of the test specimens Nos. 1 to 15 are satisfactory.

As is apparent from the foregoing description, since the machine parts in accordance with the present invention are coated respectively with Ni—P electrodeposit layers formed by electroplating using a plating bath containing a stress relaxing agent, any significant stress is not induced in the Ni—P electrodeposit layers and hence the machine parts are excellent in rolling wear resistance. The Ni—P electrodeposit layers meeting the requisite condition of the present invention can be formed in a thickness of several hundred micrometers, are capable of withstanding a high bearing stress on the order of several hundred kilograms force per square millimeter, are highly resistant to cracking and flaking, are not broken by finish machining or in use under a high load, and have excellent rolling wear resistance.

Although the invention has been described in its preferred forms with a certain degree of particularity, obviously many changes and variations are possible therein. It is therefore to be understood that the present invention may be practiced otherwise than as specifically described herein without departing from the scope and spirit thereof.

TABLE 1

| No. | Basic composition of the plating bath (g/l) | Stress relaxing agent (g/l): Saccharin | Sodium benzenesulfonate | Paratoluene sulfonamide | Plating conditions: pH | Temperature (°C.) | Current density (A/dm$^2$) | Measured data: Thickness (μm) | P content (%) | Hardness (HV) | Stress in electrodeposit (kgf/mm$^2$) | Results of rolling wear resistance test Cycles of rotation |
|---|---|---|---|---|---|---|---|---|---|---|---|---|
| | | | | | Examples of the invention | | | | | | | |
| 1 | $NiSO_4.6H_2O$:150 | 0.2 | — | — | 1.1 | 60 | 15 | 20 | 2.8 | 630 | 4.8 | 132,000 |
| 2 | $NiCl_2.6H_2O$:120 | 0.5 | 0.1 | — | 1.0 | 60 | 10 | 20 | 3.7 | 610 | 0.7 | 442,100 |
| 3 | $H_3BO_3$:1 | 0.1 | — | 0.3 | 1.2 | 60 | 10 | 20 | 1.6 | 590 | 1.8 | 341,900 |
| 4 | $H_3PO_3$:4 | 1.0 | — | — | 0.8 | 60 | 15 | 20 | 1.9 | 580 | −1.3 | 622,600 |
| 5 | $H_3PO_4$:30 | 0.5 | — | — | 0.9 | 60 | 15 | 20 | 2.2 | 612 | 0.2 | 553,000 |
| 6 | $NiSO_4.6H_2O$:130 | 0.1 | 0.1 | — | 0.5 | 70 | 30 | 20 | 4.1 | 640 | 3.8 | 218,200 |
| 7 | $NiCl_2.6H_2O$:170 | 0.5 | 0.2 | 0.1 | 0.8 | 70 | 40 | 20 | 4.0 | 635 | −0.8 | 393,700 |
| 8 | $H_3BO_3$:2 | — | 0.5 | — | 0.8 | 60 | 15 | 20 | 4.8 | 618 | 0.6 | 567,200 |
| 9 | $H_3BO_3$:8<br>$H_3PO_4$:60 | 2.0 | — | 0.1 | 0.6 | 60 | 15 | 20 | 5.5 | 620 | −1.0 | 976,600 |
| 10 | $NiSO_4.6H_2O$:200 | 2.0 | — | — | 0.9 | 50 | 5 | 20 | 5.9 | 560 | −0.8 | 772,400 |
| 11 | $NiCl_2.6H_2O$:150 | 0.5 | — | — | 1.1 | 50 | 5 | 20 | 6.2 | 522 | 0.3 | 567,000 |
| 12 | $H_3BO_3$:5 | 1.0 | — | — | 1.0 | 60 | 15 | 20 | 4.8 | 590 | −1.4 | 362,000 |
| 13 | $H_3PO_3$:5<br>$H_3PO_4$:40 | 0.1 | — | 0.1 | 1.0 | 60 | 15 | 20 | 4.2 | 598 | 5.1 | 113,200 |
| | | | | | Examples of the comparison | | | | | | | |
| 14 | $NiSO_4.6H_2O$:150 | — | — | — | 1.1 | 60 | 5 | 20 | 4.1 | 621 | 21.2 | 42,700 |
| 15 | $NiCl_2.6H_2O$:120 | — | — | — | 1.1 | 60 | 15 | 20 | 3.5 | 618 | 28.5 | 31,500 |
| 16 | $H_3BO_3$:1<br>$H_3PO_3$:4<br>$H_3PO_4$:30 | — | — | — | 1.0 | 60 | 30 | 20 | 2.8 | 633 | 32.8 | 7,800 |
| 17 | $NiSO_4.6H_2O$:130 | — | — | — | 0.5 | 60 | 5 | 20 | 6.7 | 513 | 38.2 | 27,700 |
| 18 | $NiCl_2.6H_2O$:170 | — | — | — | 0.5 | 60 | 15 | 20 | 4.3 | 615 | 35.7 | 58,300 |
| 19 | $H_3BO_3$:2<br>$H_3PO_3$:8<br>$H_3PO_4$:60 | — | — | — | 0.5 | 60 | 30 | 20 | 5.1 | 570 | 29.5 | 6,700 |

TABLE 2

| Test specimen No. | Aluminum alloys | Pretreatment※※ | Ni-P electrodeposit layer P content (wt %) | Thickness (μm) | Hardness ($HV_{100}$) | Wear resistance |
|---|---|---|---|---|---|---|
| 1 | 2014-T6 | A 100 c/m$^2$ | 0.5 | 35 | 600 | ○ |
| 2 | | A 50 c/m$^2$ | 3.1 | 10 | 650 | ⊙ |
| 3 | | A 300 c/m$^2$ | 3.6 | 50 | 655 | ⊙ |
| 4 | | A 80 c/m$^2$ | 4.1 | 120 | 658 | ⊙ |
| 5 | | A 10 c/m$^2$ | 5.7 | 300 | 682 | ⊙ |
| 6 | 2017-T4 | A 300 c/m$^2$ | 2.4 | 30 | 660 | ⊙ |
| 7 | | A 100 c/m$^2$ | 3.5 | 50 | 702 | ⊙ |
| 8 | | A 60 c/m$^2$ | 2.8 | 40 | 683 | ⊙ |
| 9 | | A 30 c/m$^2$ | 4.8 | 20 | 658 | ⊙ |
| 10 | | A 15 c/m$^2$ | 5.8 | 30 | 660 | ⊙ |
| 11 | 2014-T6 | Z 2 g/m$^2$ | 1.8 | 50 | 630 | ⊙ |
| 12 | | Z 5 g/m$^2$ | 3.4 | 50 | 620 | ⊙ |
| 13 | | Z 1 g/m$^2$ | 5.4 | 20 | 750 | ⊙ |
| 14 | | Z 3 g/m$^2$ | 8.0 | 10 | 658 | Δ |
| 15 | | Z 8 g/m$^2$ | 10.0 | 30 | 598 | Δ |
| 16 | 2014-T6 | — | — | — | — | X |
| 17 | 2017-T4 | — | — | — | — | X |
| 18 | 2014-T6 | Hard alumnite (10 μm) | — | — | — | Δ |

Note)
※⊙: Excellent
○: Good
Δ: Fair
X: Bad
※※A: Anodized layer
Z: Zincate layer

TABLE 3

| Test specimen No. | Titanium alloys | Ni-P electrodeposit layer P content (wt %) | Thickness (μm) | Heating condition (°C. × hr) | Hardness ($HV_{100}$) | Wear resistance※ |
|---|---|---|---|---|---|---|
| 1 | Ti-6Al-4V | 1.5 | 40 | — | 630 | ○ |
| 2 | | 2.8 | 10 | — | 670 | ⊙ |
| 3 | | 3.5 | 50 | — | 710 | ⊙ |
| 4 | | 5.1 | 100 | — | 713 | ⊙ |
| 5 | | 0.7 | 200 | — | 550 | ⊙ |
| 6 | Ti-15V-3Al-3Sn-3Cr | 2.4 | 50 | 500 × 1 | 530 | ⊙ |
| 7 | | 3.5 | 50 | — | 715 | ⊙ |
| 8 | | 2.8 | 20 | — | 680 | ⊙ |
| 9 | | 5.8 | 400 | 600 × 1 | 420 | ⊙ |
| 10 | | 5.8 | 400 | — | 780 | ⊙ |
| 11 | Ti-15Mo-5Zr-3Al | 1.8 | 50 | — | 690 | ⊙ |
| 12 | | 3.4 | 50 | — | 720 | ⊙ |
| 13 | | 5.4 | 100 | — | 750 | ⊙ |
| 14 | | 10.0 | 100 | 300 × 1 | 858 | X |
| 15 | | 10.0 | 100 | 400 × 1 | 910 | X |
| 16 | Ti-6Al-4V | — | — | — | 350 | X |
| 17 | Ti-15V-3Al-3Sn-3Cr | — | — | — | 450 | X |
| 18 | Ti-15Mo-5Zr-3Al | — | — | — | 420 | X |

Note)
※⊙: Excellent
○: Good
Δ: Fair
X: Bad

TABLE 4

| Test specimen No. | Titanium alloys | Ni-P electrodeposit layer P content (wt %) | Ni-P electrodeposit layer Thickness (μm) | Heating conditions (°C. × hr) | Hardness ($HV_{100}$) | Wear resistance※ |
|---|---|---|---|---|---|---|
| 1 | Ti-13V-11Cr-3Al | 0.8 | 10 | — | 520 | ○ |
| 2 | | 3.8 | 25 | — | 630 | ◎ |
| 3 | | 1.9 | 50 | — | 620 | ◎ |
| 4 | | 1.8 | 50 | 500 × 1 | 525 | ◎ |
| 5 | | 2.6 | 100 | — | 640 | ◎ |
| 6 | Ti-8V-6Cr-4Mo-4Zr-3Al | 1.9 | 45 | 450 × 10 | 680 | ◎ |
| 7 | | 1.9 | 45 | 430 × 15 | 640 | ◎ |
| 8 | | 7.0 | 45 | — | 730 | ◎ |
| 9 | | 2.7 | 200 | — | 663 | ◎ |
| 10 | | 2.7 | 200 | 600 × 1 | 420 | ◎ |
| 11 | Ti-15Mo-5Zr-3Al | 1.9 | 50 | — | 630 | ◎ |
| 12 | | 1.0 | 100 | — | 530 | ◎ |
| 13 | | 0.5 | 200 | — | 500 | ◎ |
| 14 | | 10.0 | 50 | 300 × 1 | 850 | X |
| 15 | | 10.0 | 100 | 400 × 1 | 900 | X |
| 16 | Ti-13V-11Cr-3Al | — | — | — | 450 | X |
| 17 | Ti-8V-6Cr-4Mo-4Zr-3Al | — | — | — | 420 | X |
| 18 | Ti-15Mo-5Zr-3Al | — | — | — | 420 | X |

Note)
※◎: Excellent
○: Good
Δ: Fair
X: Bad

What is claimed is:

1. A machine part comprising: a base part formed of a titanium alloy or an aluminum alloy and having a roughened surface of Ra 0.5 μm or above and $PPI_{50}$ 130 or above; and a Ni—P electrodeposit layer formed over the surface of the base part by an electroplating process using a Ni—P plating bath containing a stress relaxing agent;

wherein the stress induced in the Ni—P electrodeposit layer is 20 kgf/mm$^2$ or below; and wherein said Ni—P electrodeposit layer has a Vickers hardness of Hv 400 or above, a thickness in the range of 1.0 to 200 μm, and a P content in the range of 0.5 to 7.0% by weight, the balance being Ni.

2. A machine part according to claim 1, wherein said base part is formed of an aluminum alloy, and an anodized layer is formed between the surface of the base part and the Ni—P electrodeposit layer.

3. A machine part according to claim 1, wherein said base part is formed of an aluminum alloy, and a zincate layer is formed between the surface of the base part and said Ni—P electrodeposit layer.

4. A machine part according to any one of claims 1, 2 or 3, wherein said Ni—P electrodeposit layer has a Vickers hardness in the range of Hv 550 to Hv 700.

5. A machine part according to any one of claims 1, 2 or 3, wherein said Ni—P electrodeposit layer has a thickness in the range of 10 to 50 μm.

6. A machine part according to any one of claims 1, 2 or 3, wherein said Ni—P electrodeposit layer has a P content in the range of 0.5 to 3.9% by weight.

7. A machine part according to any of claims 1, 2 or 3, wherein the stress induced in the Ni—P electrodeposit layer is within ±5.0 kgf/mm$^2$.

8. The machine part of claim 1, wherein said Ni—P plating bath contains 0.01 to 2.0 g/l of said stress relaxing agent.

9. The machine part of claim 1, wherein said stress relaxing agent is selected from the group consisting of saccharin, sodium saccharin, paratoluene sulfonamide, sodium benzenesulfonate and a mixture thereof.

10. The machine part of claim 1, wherein said stress relaxing agent is selected from the group consisting of saccharin, sodium benzenesulfonate and a mixture thereof.

11. The machine part of claim 1, wherein said Ni—P plating bath comprises 100 to 200 g/l $NiSO_4.6H_2O$, 40 to 200 g/l $NiCl_2.6H_2O$, 0.5 to 10 g/l $H_3BO_3$, 2 to 20 g/l $H_3PO_3$. 10 to 150 g/l $H_3PO_4$ and 0.01 to 5.0 g/l stress relaxing agent.

12. The machine part of claim 1, wherein said electroplating process is conducted at a bath temperature of 40° to 70° C., a current density of 5 to 50 A/dm$^2$ and a pH of 0.5 to 3.0.

* * * * *

UNITED STATES PATENT AND TRADEMARK OFFICE

CERTIFICATE OF CORRECTION

PATENT NO. : 5,496,651

DATED : March 5, 1996

INVENTOR(S) : Hidetoshi NISHIMOTO, ET AL.

It is certified that error appears in the above-indentified patent and that said Letters Patent is hereby corrected as shown below:

Title page item [56], entitled "FOREIGN PATENT DOCUMENTS", by inserting after

| | | |
|---|---|---|
| "4-26792 | 1/1992 | Japan" |
| --50-6534 | 1/1975 | Japan |
| 1-222091 | 9/1989 | Japan |
| 58-1087 | 1/1983 | Japan |
| 59-185794 | 10/1984 | Japan |
| 1-106909 | 4/1989 | Japan |
| 64-8295 | 1/1989 | Japan-- |

Signed and Sealed this

Fifteenth Day of October, 1996

*Attest:*

*Attesting Officer*

BRUCE LEHMAN

*Commissioner of Patents and Trademarks*